United States Patent [19]

Pasternak

[11] Patent Number: 4,858,340

[45] Date of Patent: Aug. 22, 1989

[54] SHOE WITH FORM FITTING SOLE

[75] Inventor: Stephen M. Pasternak, Englewood, Fla.

[73] Assignee: Prince Manufacturing, Inc., Princeton, N.J.

[21] Appl. No.: 156,282

[22] Filed: Feb. 16, 1988

[51] Int. Cl.[4] ..... A43B 7/14; A43B 13/28

[52] U.S. Cl. ..... 36/88; 36/12; 36/30 R

[58] Field of Search ..... 36/11, 12, 14, 16, 18, 36/19, 22 R, 32 R, 30 R, 28, 88, 93

[56] References Cited

U.S. PATENT DOCUMENTS

| | | | |
|---|---|---|---|
| 3,730,169 | 5/1973 | Fiber | 128/25 |
| 3,781,231 | 12/1973 | Janssen et al. | 260/25 BE |
| 4,128,950 | 12/1978 | Bowerman et al. | 36/30 R |
| 4,224,747 | 9/1980 | Winfield | 36/11 |
| 4,306,361 | 12/1981 | Kaschura | 36/92 |
| 4,399,620 | 8/1983 | Funck | 36/28 |
| 4,463,761 | 8/1984 | Pols et al. | 36/88 |
| 4,501,076 | 2/1985 | Dodds | 36/11 |
| 4,505,055 | 3/1985 | Bergmans | 36/18 |
| 4,541,184 | 9/1985 | Leighton | 36/44 |
| 4,551,929 | 11/1985 | Paris | 36/14 |
| 4,627,178 | 12/1986 | Sullivan et al. | 36/44 |
| 4,685,223 | 8/1987 | Long | 36/12 |

FOREIGN PATENT DOCUMENTS

| | | | |
|---|---|---|---|
| 497971 | 1/1951 | Belgium | 36/12 |
| 2836793 | 3/1980 | Fed. Rep. of Germany | 36/30 R |
| 1082998 | 6/1954 | France | 36/14 |
| 501770 | 11/1954 | Italy | 36/14 |

*Primary Examiner*—Steven N. Meyers
*Attorney, Agent, or Firm*—White & Case

[57] ABSTRACT

A shoe, e.g. a sports shoe or a walking shoe, has an upper and a multi-layer sole including an elastic sock liner stitched to the upper, a deformable top sole, a midsole of elastic material, and a wear resistant outsole. The top sole is anatomically shaped and formed of a material possessing a high hysteresis to conform to the contours of the foot and to retain such shape during running, walking, or active sports.

6 Claims, 1 Drawing Sheet

SHOE WITH FORM FITTING SOLE

FIELD OF THE INVENTION

The present invention relates to shoes such as sports shoes for tennis but can also be applied to casual or "walking" shoes.

BACKGROUND OF THE INVENTION

In one widely used construction of a tennis shoe, the shoe upper is adhered to an insole piece of tough artificial soling material, such as Texon or Bontex, and then a rubber or polyurethane outsole is affixed to the insole and upper, such as by adhesion or stitches. The Texon or Bontex insole pieces are flat, which greatly facilitates the manufacturing of the shoe. But, because the inside of the shoe thus formed is also flat, and made of the relatively hard insole material, manufacturers usually slip a resilient foam insert piece into the shoe which is shaped in the heel and instep areas to cradle the foot and thus make the shoe more comfortable.

When running or walking, these various materials all return to their original flat shapes when the foot is lifted off the ground. When the foot again steps down, the materials compress. But, because the foot is not flat, certain areas of the foot make contact first and press down harder. In shoes with a normal EVA midsole, in fact, the foot is never fully in contact with the shoe.

It would be desirable to have a sole with an upper surface which matches the individual contours of the foot. With such a sole, the impact of running or walking would be taken up more uniformly across the foot area, and the shoe would feel much more comfortable. Also, the foot would slip less inside the shoe.

Since all feet have different shapes, anatomically molded components, such as the insert piece described above, cannot possibly fit everyone. Only a moldable component can conform to any foot and therefore fit properly.

One technique for making a sole contoured to the foot is that which is used in making certain customized ski boots. In this technique, foam is blown into the boot while on the foot of the wearer. Even if this technique could be adapted to tennis shoes, it would be prohibitive in cost.

More recently, in U.S. Pat. No. 3,730,169, it is proposed to modify the slip-in insert piece to have dual layers, one of which is of the normal resilient material and the other of which is a material that permanently deforms to adopt the shape of the foot. The proposal according to the '169 patent thus seeks to improve the function of the insert piece, which as described about is present as a remedy to the fact that the sole itself is flat, rather than anatomically shaped, and that the insole piece makes the sole not particularly resilient. The patent does not address the structure of the shoe itself.

SUMMARY OF THE INVENTION

The present invention is a novel shoe construction in which the sole is formed of a combination of materials that provide the requisite toughness and resiliency, but which also, when in use, anatomically conform to the contours of the foot and maintain such contours during walking, running and active sports.

More particularly, a sports shoe according to the invention includes an upper and a sole attached thereto to define a foot-receiving space. The sole comprises an outsole made of rubber, polyurethane, or any other suitable wear resistant soling material; a resilient midsole made e.g. of EVA; a top sole of a high hysteresis, low resilience, low memory material, e.g. a high hysteresis polyurethane foam; and an elastic upper sock liner. Preferably the top sole is anatomically shaped.

In a preferred embodiment, the outsole has upwardly extending sidewalls that define a cavity in which the midsole and top sole are disposed. The sidewalls are also stitched to the upper. The sock is stitched to the lower edges of the upper.

The shoe may be formed by a slip lasting process. A pre-formed upper is stitched to the elastic sock, and then slipped onto a last in the shape of a foot. The midsole and top sole are glued into the cavity of a preformed outsole, and the multipiece sole is then positioned on the last, glued to the sock, and heat set. The shoe is thereafter removed from the last, and the upper is stitched to the upstanding sidewalls of the outsole.

Under the person's weight, the top sole and midsole compress. Due to the presence of the elastic sock liner, the contours of the foot are imparted directly to the top sole so that it conforms to the foot. During walking, running and active sports, the high hysteresis characteristics of the top sole cause it to retain the foot contour when weight is taken off the shoe for short periods of time. In this manner, when the user steps down on the shoe, the impact is distributed evenly across the foot, and shock is absorbed by the resilient midsole.

For a better understanding of the invention, reference is made to the following detailed description of a preferred embodiment in conjunction with the accompanying drawings.

DETAILED DESCRIPTION OF A PREFERRED EMBODIMENT

Figure 1:
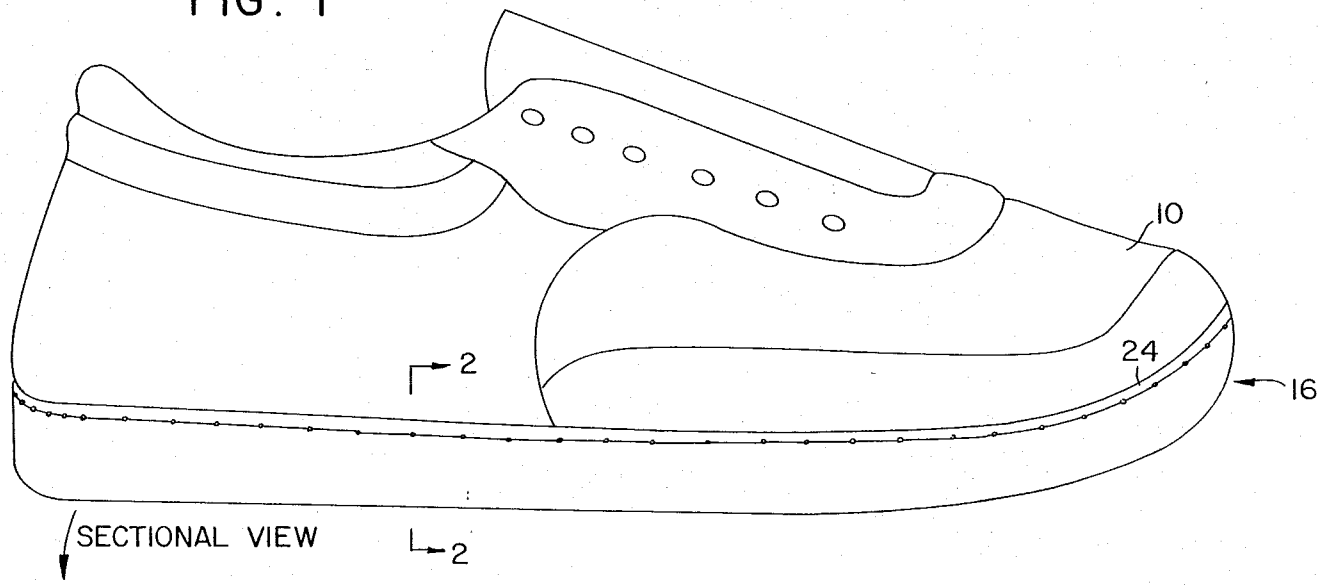
FIG. 1 is a side view of a sports shoe according to the invention.

FIG. 1 shows a tennis shoe having an upper 10 and a sole 16. The sole includes a thin, elastic sock liner 12 which is stitched to the lower ends 13 of the upper 10 by stitches 14 to define a foot receiving space. The sole also includes an outsole 18, a resilient midsole 20, and an anatomically shaped top sole 22.

Figure 2:
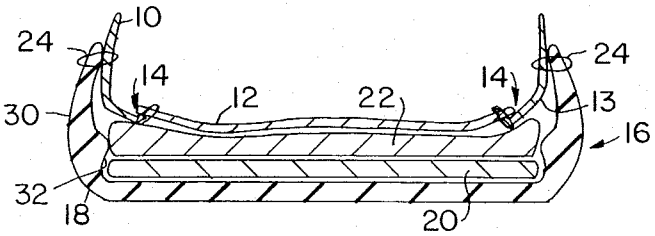
FIG. 2 is a cross-sectional view, taken through lines 2—2 of FIG. 1.
Figure 3:
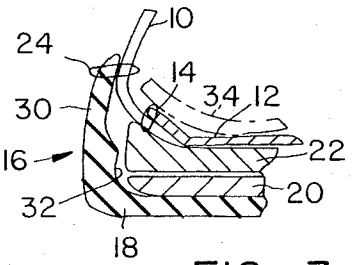
FIG. 3 is a side sectional view of the heel portion of FIG. 1.

As shown in FIGS. 2 and 3, the outsole is formed with upwardly extending sidewalls 30 that extend around the shoe to define a cavity 32 open at the top. The midsole 20 and top sole 22 are disposed within the cavity 32 and surrounded by the sidewalls 30. The sock liner 12 and lower ends 13 of the upper are disposed within the cavity, so that the lower ends 13 abut the sidewalls 30. The upper 10 is stitched to the sidewalls 30 as shown by stitches 24.

In an exemplary embodiment, the outsole 18 is made of a wear resistant material such as high density polyurethane or rubber. The midsole 20 is made of a resilient material for cushioning, such as EVA. The sock liner 12 is made of any two dimensionally stretchable material, such as a nylon fabric.

The top sole 22 is made of a deformable material, such as an oil extended polyurethane, that possesses a high hysteresis with a "memory", so that when weight is applied by the foot the material assumes the shape of the foot, and when weight is removed it returns slowly to its original uncompressed state. An example of a suitable material is a high hysteresis microcellular microdiethelene (MDI) having a specific gravity between 0.25 and 0.4 g/cm$^3$. As shown in FIGS. 2 and 3 the material is pre-molded into an approximate anatomical shape in the heel and arch areas, i.e., to have upraised side edges. The forward part of the top sole, i.e. in the ball and toe areas of the foot, can be flat.

An oil extended polyurethane having the properties described above is one example of a suitable top sole material that may be cut or molded into an approximate anatomical shape, which will deform to conform to the shape of the bottom of the foot, and which will retain such contours for a period of time while the shoe is off the ground. However, it is possible to provide other materials having these requisite properties, i.e. other polymers which are technologically engineered to have a high hysteresis curve showing a low memory, which materials may be used as the top sole.

The thickness of the top sole, midsole, and outsole may be selected to provide the desired combination of wear, resilience, and conformability in the sole. Depending on the specific sport or activity for which the shoe is designed, as an example, the outsole may have a thickness of about 5 mm., the midsole a thickness of about 6–12 mm. front-to-heel, and the top sole a thickness of about 6–12 mm. toe-to-heel. The thickness of the midsole and top sole may be less in the forward areas of the shoe.

A shoe according to the invention may be constructed by stitching a pre-formed upper 10 to the sock liner 12, which unit is then slipped onto an anatomically shaped last (i.e., shaped to match the upturned sides of the top sole 22). In a separate operation, the outsole 18, midsole 20, and shaped top sole piece 22 are cut or molded. The midsole 20 and top sole 22 are placed into the outsole cavity 32 and glued to one another. The sole assembly is then fitted onto the last and the top sole 22 is glued to the sock liner 12, whereafter the shoe is removed from the last and stitched at 24.

Because the sock liner 12 is two dimensionally elastic, it is able to follow the deformation of the top sole 22 and thus permit the top sole to adopt the contours of the foot. The anatomical shape of the top sole provides improved comfort. Moreover, because of the wrap-around construction of the shoe, in which the top sole is securely held in the cavity of the outsole, and in which the outsole also wraps around the foot, and because the upper surface of the top sole is specifically contoured to the shape of the foot, there will be less movement of the foot inside the shoe.

For additional comfort, a removable inner footbed (shown in phantom at 34 in FIG. 3) may be provided. The material and construction should be chosen to enhance the feel and performance of the sock liner and top sole custom fit characteristics. By way of example, a footbed is used when it is desirable to provide an additional thickness of the compressible (top sole) material. In this example, the footbed is of a composition similar to the top sole. The exact characteristics are selected to provide the optimal feel and performance depending upon the type of shoe. The top and bottom surface of the footbed are anatomically shaped to conform to the foot and sock liner profiles, respectfully.

The foregoing represents a description of a preferred embodiment of the invention. Variations and modifications of the described embodiment will be apparent to persons skilled in the art, without departing from the inventive concepts disclosed herein. All such modifications and variations are intended to be within the scope of the invention as defined in the following claims.

I claim:

1. A shoe comprising an upper and a sole affixed thereto to define a foot-receiving space, wherein the sole comprises: a first sole element of a resilient material, a second sole element in the form of an elastic sock liner forming the uppermost layer of the sole, and a third sole element of a deformable material having a high hysteresis, wherein the third element is disposed between the first and second elements and said elements are bonded together.

2. A shoe according to claim 1, wherein said sole further comprises an outsole having upwardly extending sidewalls defining a cavity, wherein said first and third elements comprise a midsole and a top sole, respectively, and are disposed in said cavity, and wherein said midsole is bonded to said outsole.

3. A shoe according to claim 2, wherein said upper includes lower ends, and comprising means for stitching said lower ends to said sock liner.

4. A shoe as defined in claim 3, wherein the lower ends of the upper are contained by the outsole sidewalls, and comprising means for stitching said sidewalls to said lower ends.

5. A shoe as defined in claim 1, wherein said third element is anatomically shaped to have upwardly extending side edges in the heel and instep areas.

6. A shoe as defined in claim 1, wherein said third element is an oil extended polyurethane that substantially conforms to the contours of the foot under weight, and substantially retains such contours for a period of time corresponding to the time between steps during running, walking, or active sports.

* * * * *